US010877407B2

(12) United States Patent
Furuichi et al.

(10) Patent No.: US 10,877,407 B2
(45) Date of Patent: Dec. 29, 2020

(54) HEATING DEVICE, FIXING DEVICE, AND IMAGE FORMING APPARATUS

(71) Applicants: Yuusuke Furuichi, Kanagawa (JP); Tomoya Adachi, Kanagawa (JP); Yukimichi Someya, Saitama (JP)

(72) Inventors: Yuusuke Furuichi, Kanagawa (JP); Tomoya Adachi, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/502,348

(22) Filed: Jul. 3, 2019

(65) Prior Publication Data

US 2020/0033771 A1 Jan. 30, 2020

(30) Foreign Application Priority Data

Jul. 25, 2018 (JP) ..... 2018-139245
Apr. 11, 2019 (JP) ..... 2019-075468

(51) Int. Cl.
*G03G 15/20* (2006.01)
*G03G 15/00* (2006.01)

(52) U.S. Cl.
CPC ..... *G03G 15/2053* (2013.01); *G03G 15/80* (2013.01)

(58) Field of Classification Search
CPC . G03G 15/2053; G03G 15/2039; G03G 15/80
See application file for complete search history.

(56) References Cited

U.S. PATENT DOCUMENTS 9,235,166 B2 * 1/2016 Shimura ..... G03G 15/2039
9,772,587 B2 * 9/2017 Iwasaki ..... G03G 15/2053
2019/0179242 A1 6/2019 Adachi et al.
2019/0196374 A1 6/2019 Adachi et al.

OTHER PUBLICATIONS

U.S. Appl. No. 16/352,390, filed Mar. 13, 2019, Tomoya Adachi, et al.
U.S. Appl. No. 16/285,733, filed Feb. 26, 2019, Yuusuke Furuichi, et al.
U.S. Appl. No. 16/263,634, filed Jan. 31, 2019, Yuusuke Furuichi, et al.
U.S. Appl. No. 16/269,616, filed Feb. 7, 2019, Tomoya Adachi, et al.
U.S. Appl. No. 16/276,807, filed Feb. 15, 2019, Yukimichi Someya, et al.

* cited by examiner

*Primary Examiner* — Hoang X Ngo
(74) *Attorney, Agent, or Firm* — Harness, Dickey and Pierce, P.L.C.

(57) ABSTRACT

A heating device includes a heater and a holder. The heater includes a plate, an electrode disposed on one surface of the plate, and a heat generator. The heater does not include another electrode on the other surface of the plate opposite the one surface on which the electrode is disposed, and in a portion on the plate corresponding to the electrode. The holder includes a contact portion to contact the plate in a thickness direction of the plate, and at least one of a plurality of portions, a gap at a location corresponding to the electrode, existing between the plurality of portions and a single portion, at least a part of the single portion corresponding to the electrode, being relatively thinner than a part of the single portion corresponding to the heat generator.

27 Claims, 10 Drawing Sheets

HEATING DEVICE, FIXING DEVICE, AND IMAGE FORMING APPARATUS

CROSS-REFERENCE TO RELATED APPLICATIONS

This patent application is based on and claims priority pursuant to 35 U.S.C. § 119 to Japanese Patent Applications No. 2018-139245, filed on Jul. 25, 2018 and No. 2019-075468, filed on Apr. 11, 2019 in the Japanese Patent Office, the entire disclosure of each of which is hereby incorporated by reference herein.

BACKGROUND

Technical Field

Embodiments of the present disclosure generally relate to a heating device, a fixing device, and an image forming apparatus.

Background Art

A laminated heater having a planar resistive heat generator is known as a heater used for a drying device to dry ink on a sheet or a fixing device to fix toner on the sheet by heat in an image forming apparatus such as a printer and a copier.

The laminated heater generates heat when power is supplied to the resistive heat generator. Therefore, the laminated heater includes an electrode to which a connector is electrically connected to supply power from the power supply.

SUMMARY

This specification describes an improved heating device that includes a heater and a holder. The heater includes a plate, an electrode disposed on one surface of the plate, and a heat generator. The heater does not include another electrode on the other surface of the plate opposite the one surface on which the electrode is disposed, and in a portion on the plate corresponding to the electrode. The holder includes a contact portion to contact the plate in a thickness direction of the plate, and at least one of a plurality of portions, a gap at a location corresponding to the electrode, existing between the plurality of portions and a single portion, at least a part of the single portion corresponding to the electrode, being relatively thinner than a part of the single portion corresponding to the heat generator.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
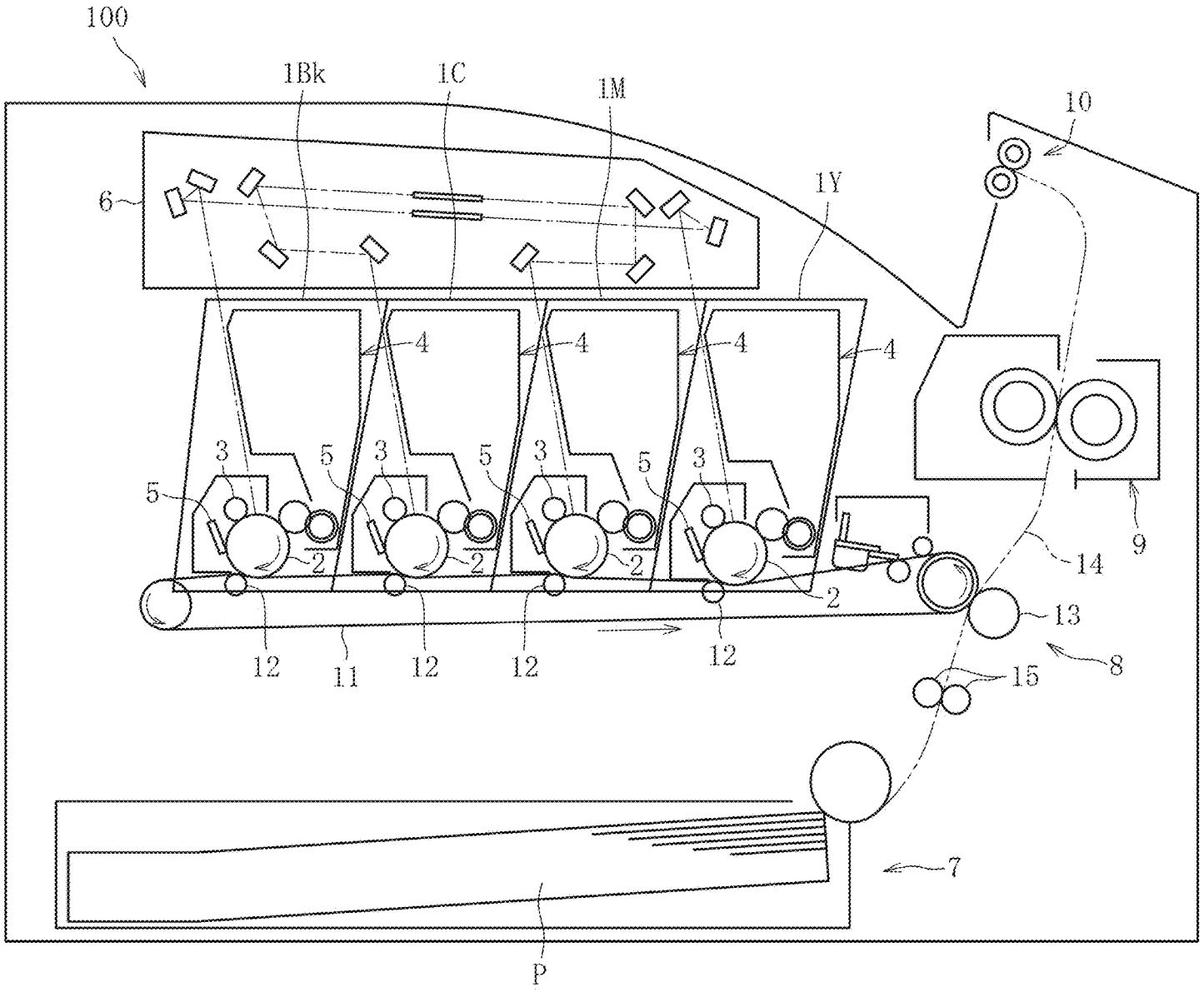
FIG. 1 is a schematic configuration diagram of an image forming apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

With reference to drawings, a description is given below of a configuration and an operation of an image forming apparatus 100 according to an embodiment of the present disclosure. In the description below, elements or components identical or similar in function or shape are given an identical reference character as far as possible to distinguish, and redundant descriptions are omitted.

FIG. 1 is a schematic diagram illustrating a configuration of an image forming apparatus according to an embodiment of the present disclosure.

The image forming apparatus 100 illustrated in FIG. 1 includes four image forming units 1Y, 1M, 1C, and 1Bk detachably attached to an apparatus body thereof. The image forming units 1Y, 1M, 1C, and 1Bk have the same configuration except for containing different color developers, i.e., yellow (Y), magenta (M), cyan (C), and black (Bk) toners, respectively, corresponding to decomposed color separation components of full-color images. Specifically, each of the image forming units 1Y, 1M, 1C, and 1Bk includes: a photoconductor 2 in a drum-like shape as an image bearer; a charger 3 to charge a surface of the photoconductor 2; a developing device 4 configured to form a toner image by supplying toner, as a developer, to a surface of the photoconductor 2; and a cleaner 5 to clean the surface of the photoconductor 2.

The image forming apparatus 100 further includes an exposure device 6 to expose the surface of each photoconductor 2 to form an electrostatic latent image, a sheet feeder 7 to supply a sheet P as a recording medium, a transfer device 8 to transfer the toner image formed on each photoconductor 2 onto the sheet P, a fixing device 9 to fix the transferred toner image onto the sheet P, and an output device 10 to eject the sheet P outside the image forming apparatus 100.

The transfer device 8 includes: an intermediate transfer belt 11 in the form of an endless belt stretched taut with multiple rollers, as an intermediate transferor; four primary transfer rollers 12 each as a primary transferor to transfer the toner image formed on each photoconductor 2 onto the intermediate transfer belt 11; and a secondary transfer roller 13 as a secondary transferor to transfer the toner image transferred onto the intermediate transfer belt 11 onto the sheet P. The primary transfer rollers 12 are in contact with the respective photoconductors 2 via the intermediate transfer belt 11. Therefore, the intermediate transfer belt 11 is in contact with the respective photoconductors 2, thus forming primary transfer nips therebetween. The secondary transfer roller 13 contacts, via the intermediate transfer belt 11, one of the plurality of rollers around which the intermediate transfer belt 11 is stretched. Thus, the secondary transfer nip is formed between the secondary transfer roller 13 and the intermediate transfer belt 11.

In the image forming apparatus 100, a sheet conveyance path 14 is formed through which the sheet P fed from the sheet feeder 7 is conveyed. A timing roller pair 15 is disposed on the sheet conveyance path 14 on the way from the sheet feeder 7 to the secondary transfer nip (the secondary transfer roller 13).

Next, a description is given of a print operation of the image forming apparatus 100 with reference to FIG. 1.

As a print operation start is instructed, in each of the image forming units 1Y, 1M, 1C, and 1Bk, the photoconductors 2 are each driven to rotate clockwise in FIG. 1 and the surfaces thereof are uniformly charged to a high potential by the respective chargers 3. Subsequently, according to either image data of a document scanned by a scanner or print data instructed from a terminal, the exposure device 6 exposes the surface of the photoconductor 2. Thus, the potential of the exposed portion decreases, and an electrostatic latent image is formed. The developing device 4 supplies toner to the electrostatic latent image, thereby developing the latent image into the toner image on each of the photoconductors 2.

The toner image on each of the photoconductors 2 reaches the primary transfer nip at each of the primary transfer rollers 12 in accordance with rotation of each of the photoconductors 2 and is sequentially transferred and superimposed onto the intermediate transfer belt 11 that is driven to rotate counterclockwise in FIG. 1. In accordance with rotation of the intermediate transfer belt 11, the toner image transferred onto the intermediate transfer belt 11 reaches the secondary transfer nip at the secondary transfer roller 13 and is transferred onto the conveyed sheet P at the secondary transfer nip. The sheet P is fed from the sheet feeder 7. The timing roller pair 15 temporarily stops the sheet P fed from the sheet feeder 7 and conveys the sheet P to the secondary transfer nip, timed to coincide with the toner image on the intermediate transfer belt 11. Thus, a full-color toner image is formed on the sheet P After the toner image is transferred from each of the photoconductors 2 onto the intermediate transfer belt 11, each of cleaners 5 removes residual toner on each of the photoconductors 2.

After the toner image is transferred onto the sheet P, the sheet P is conveyed to the fixing device 9 to fix the toner image on the sheet P. Subsequently, the output device 10 ejects the sheet P outside the image forming apparatus 100, and a series of print operations are completed.

Next, a configuration of the fixing device 9 is described.

Figure 2:
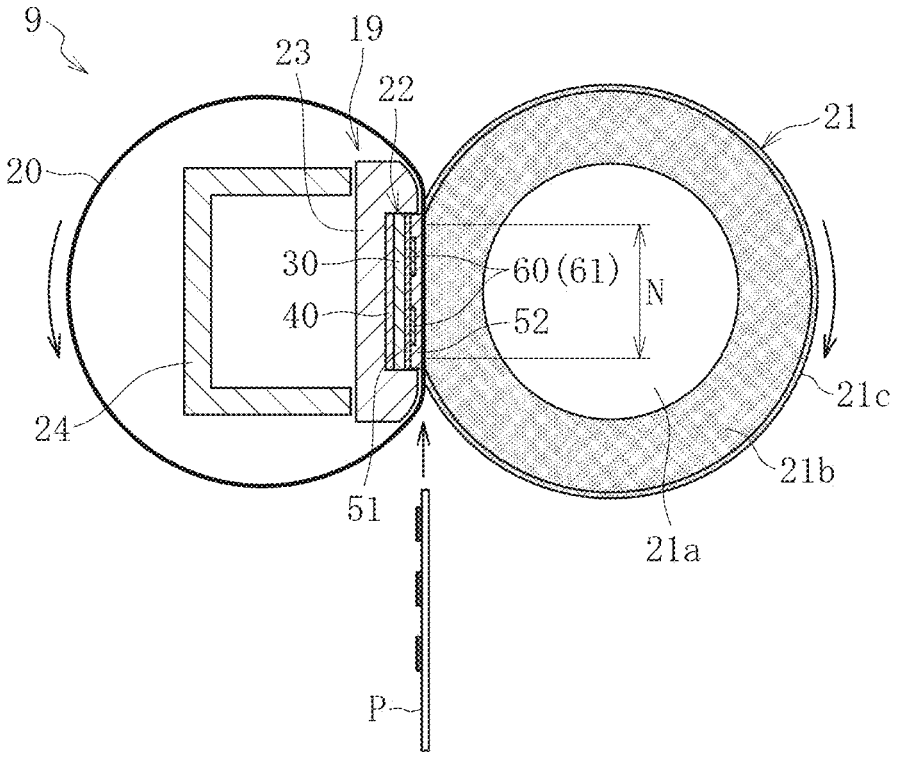
FIG. 2 is a schematic diagram illustrating a configuration of a fixing device.

As illustrated in FIG. 2, the fixing device 9 according to the present embodiment includes an endless fixing belt 20 as a fixing rotator, a pressure roller 21 as an opposed rotator to contact an outer circumferential surface of the fixing belt 20 and form a nip N, and a heating device 19 to heat the fixing belt 20. The heating device 19 includes a laminated heater 22 as a heater, a heater holder 23 as a holder to hold the heater 22, and a stay 24 as a supporter to support the heater holder 23.

The fixing belt 20 includes, for example, a tubular base made of polyimide (PI), and the tubular base has an outer diameter of 2.5 mm and a thickness of from 40 to 120 μm. On the outermost layer of the fixing belt 20, a release layer made of a fluorine-based resin, such as a perfluoroalkoxy alkane (PFA) or polytetrafluoroethylene (PTFE), having a thickness of from 5 to 50 μm, is formed in order to improve durability and ensure releasability. An elastic layer made of rubber having a thickness of from 50 to 500 μm may be provided between the tubular base and the release layer. The tubular base of the fixing belt 20 is not limited to polyimide, and thus may be made of heat-resistant resin, such as polyetheretherketone (PEEK), or a metal, such as nickel (Ni) or stainless steel (SUS). The inner circumferential surface of the fixing belt 20 may be coated with polyimide or polytetrafluoroethylene (PTFE) as a slide layer.

The pressure roller 21 having, for example, an outer diameter of 25 mm, includes a solid iron bar 21*a*, an elastic layer 21*b* on the surface of the bar 21*a*, and a release layer 21*c* formed on the outside of the elastic layer 21*b*. The elastic layer 21*b* made of silicone rubber has, for example, a thickness of 3.5 mm. Preferably, the release layer 21*c* is formed by a fluororesin layer having, for example, a thickness of approximately 40 μm on the surface of the elastic layer 21*b* to improve releasability.

The heater 22 extends in a longitudinal direction thereof parallel to a width direction of the fixing belt 20. The heater 22 includes a heat insulation layer 40, a base layer 30, a first insulation layer 51, a conductor layer 60 that includes a heat generator 61, and a second insulation layer 52, which are layered in this order from the heater holder 23 toward the fixing belt 20, that is, the nip N. The heat insulation layer 40 is a layer made of a material having a thermal conductivity lower than that of the base layer 30. Instead of the heat insulation layer 40, a thermally conductive layer having a thermal conductivity higher than that of the base layer 30 may be provided. That is, a layer having a thermal conductivity different from that of the base layer 30 such as the heat insulation layer or the thermally conductive layer is provided on the surface opposite the surface of the base layer 30 on which the heat generator 61 is provided.

The heater holder 23 and the stay 24 are disposed inside the inner circumferential surface of the fixing belt 20. The stay 24 is configured by a channeled metallic member, and both side plates of the fixing device 9 support respective end portions of the stay 24. Supporting the heater holder 23 and the heater 22 held by the heater holder 23 by the stay 24 causes the heater 22 to reliably receive a pressing force of the pressure roller 21 while the pressure roller 21 presses the fixing belt 20 and forms the nip N stably.

The heater holder 23 is preferably made of heat-resistant material because heat from the heater 22 causes the heater holder 23 to be high temperature. The heater holder 23 made of heat-resistant resin having low thermal conduction, such as a liquid crystal polymer (LCP) reduces heat transfer from the heater 22 to the heater holder 23 and enables to efficiently heat the fixing belt 20.

A biasing member such as a spring presses the pressure roller 21 against the fixing belt 20. As a result, the pressure roller 21 is pressed against the heater 22 via the fixing belt 20 to form the nip N between the fixing belt 20 and the pressure roller 21. A driver drives and rotates the pressure roller 21 in a direction of an arrow illustrated in FIG. 2, and this rotation of the pressure roller 21 rotates the fixing belt 20.

When the print operation starts, the pressure roller 21 is driven to rotate, and the fixing belt 20 starts to be rotated. The heater 22 is supplied with power, heating the fixing belt 20. When the temperature of the fixing belt 20 reaches a predetermined target temperature called a fixing temperature, as illustrated in FIG. 2, the sheet P bearing an unfixed toner image is conveyed to the nip N between the fixing belt 20 and the pressure roller 21, and the unfixed toner image is heated and pressed to be fixed to the sheet P.

Figure 3:
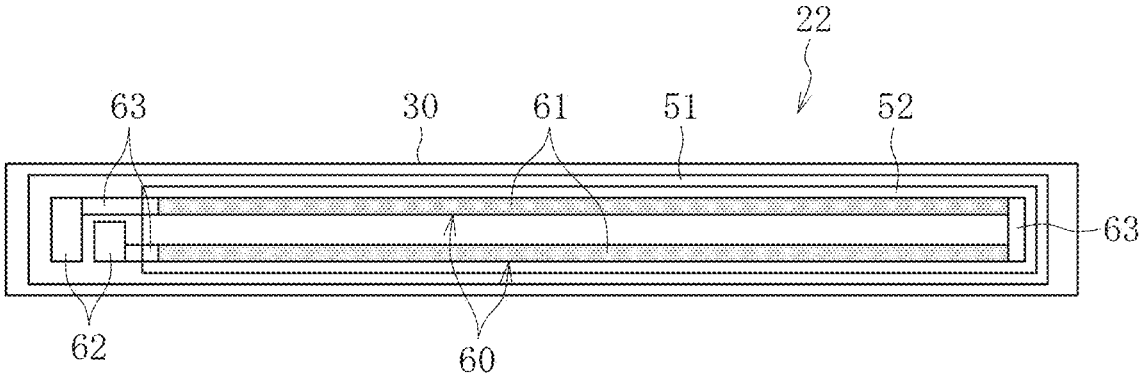
FIG. 3 is a plan view of a heater.
Figure 4:
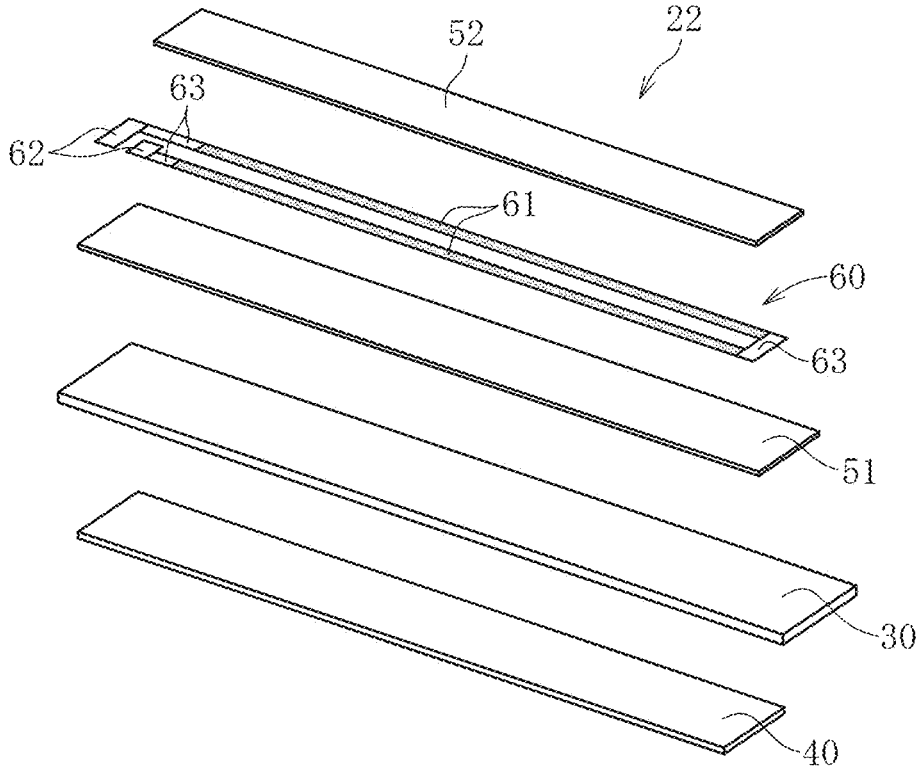
FIG. 4 is an exploded perspective view of the heater.

FIG. 3 is a plan view of the heater 22 as viewed from the front side, and FIG. 4 is an exploded perspective view of the heater 22. In the following description according to the present embodiment, the fixing belt 20 side, that is, the nip N side with respect to the heater 22 is referred to as "front side", and the heater holder 23 side is referred to as "back side". Additionally, in the following description, a direction in which the heater 22 extends in a rotational axis direction of the fixing belt 20 is referred to as "a longitudinal direction" of the heater 22, and the direction in which the layers of the heater 22 are layered is referred to as "a thickness direction" of the heater 22. Further, a direction perpendicular to both the "longitudinal direction" of the heater 22 and the "thickness direction" of the heater 22 is referred to as "a short side direction" of the heater 22.

As illustrated in FIG. 4, the heater 22 according to the present embodiment is a heater including a plurality of layers. The plurality of layers included in the heater 22 are integrally formed. A method to form the layers integrally is, for example, a method coating the base layer 30. In the present embodiment, examples of the plurality of layers included in the heater 22 are as follows. The heater 22 according to the present embodiment includes the flat base layer 30, the first insulation layer 51 disposed on the front side of the base layer 30, the conductor layer 60 disposed on the front side of the first insulation layer 51, the second insulation layer 52 that covers the front side of the conductor layer 60, and the heat insulation layer 40 disposed on the back side of the base layer 30 and is configured by stacking the plurality of these layers. In the present embodiment, each of the base layer 30, the first insulation layer 51, and the heat insulation layer 40 forms a plate on which the conductor layer 60 is disposed. The heater 22 according to the present embodiment is the plate with an electrode and a heat generator on either the front side of the plate or the back side of the plate. In the present embodiment, the plate is configured by a plurality of layers, but the plate may be configured by a single layer. The conductor layer 60 includes a pair of heat generators 61 formed of planar resistance heating elements, a pair of electrodes 62 disposed on one end in the longitudinal direction of each heat generator 61, and a plurality of power supply lines 63 connecting between the electrode 62 and the heat generator 61 and the heat generators 61 to each other. In addition, as illustrated in FIG. 3, at least one part of each electrode 62 in the conductor layer 60 is exposed without being covered by the second insulation layer 52 in order to ensure connection with a connector described later.

The heat generator 61 may be made, for example, by coating on the base layer 30 with paste in which silver palladium (AgPd) and glass powder are compounded, by screen printing, and after that, by baking the base layer 30. The material of the heat generator 61 may include a resistance material, such as silver alloy (AgPt) or ruthenium oxide (RuO2), other than the above material. In the present embodiment, the pair of heat generators 61 extends in the longitudinal direction of the base layer 30 in parallel with each other. Right ends of the heat generators 61 in FIG. 3, that is, ends of heat generators 61 in one side are electrically connected to each other through the power supply line 63, and left ends of the heat generators 61 in FIG. 3, that is, ends of heat generators 61 in the other side are electrically connected to the electrodes 62 through the different power supply lines 63. The power supply lines 63 are made of a conductor having an electrical resistance smaller than that of the heat generators 61. Silver (Ag), silver palladium (Aged) or the like may be used as a material of the power supply line 63 or the electrode 62, and screen-printing such a material forms the power supply line 63 or the electrode 62.

The base layer 30 is made of a metal material such as stainless steel (SUS), iron, or aluminum, Or, the base layer 30 may be made of ceramic, glass, etc. other than the metal material. Each of the first insulation layer 51, the second insulation layer 52, and the heat insulation layer 40 is made of heat resistant glass. Or, these layers may be made of ceramic or polyimide (PI) etc. Even when the base layer 30 is made of aluminum nitride, coating the materials of the layers other than the base layer 30 enables integrally forming the layers.

Figure 5:
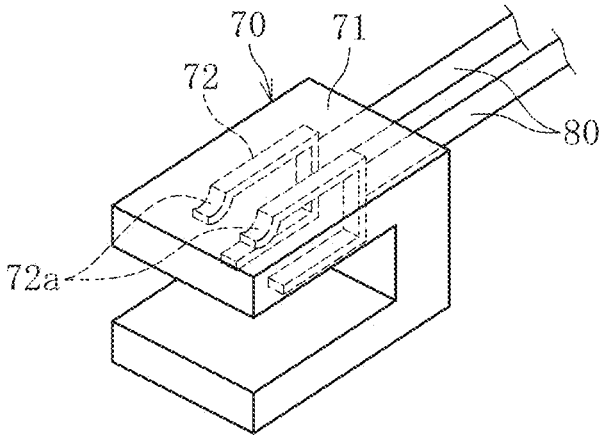
FIG. 5 is a perspective view of a connector.

FIG. 5 is a perspective view illustrating the connector 70 coupled to the heater 22. The heating device 19 according to the present embodiment includes the connector 70 to supply power to the heat generator 61 of the heater 22. As illustrated in FIG. 5, the connector 70 includes a housing 71 made of resin and a contact terminal 72 including a flat spring fixed to the housing 71. The contact terminal 72 has a pair of contact portions 72*a* to contact the respective electrodes 62 of the heater 22. In addition, a power supply harness 80 is coupled to the connector 70, that is, the contact terminal 72.

Figure 6:
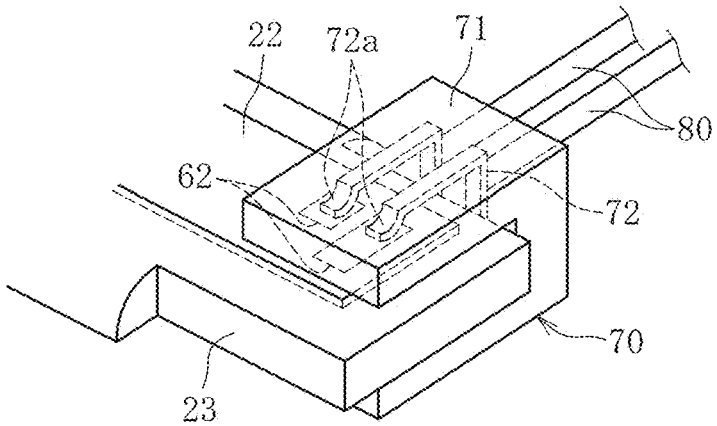
FIG. 6 is a perspective view illustrating the connector connected to the heater.

As illustrated in FIG. 6, the connector 70 is attached so as to sandwich the heater 22 and the heater holder 23 from the front side and the back side together. Thus, the contact portions 72*a* of the contact terminal 72 elastically contact and press against the electrodes 62 of the heater 22, and the heat generator 61 is electrically connected to the power supply provided in the image forming apparatus via the connector 70 and is powered by the power supply.

In a configuration in which the connector sandwiches and holds the heater and the heater holder together, any variation in the thickness of the heater or the heater holder (that is, a distance from the front surface to the back surface in each of the heater and the heater holder) changes a contact position between the contact portions of the contact terminal and the electrode of the heater in the thickness direction. As a result, the contact pressure of the contact terminal with respect to the electrode also varies. Increase of the variation in the contact pressure of the contact terminal due to the combined tolerances in the thicknesses of the heater and the heater holder complicates control of the contact pressure to an appropriate value (within an appropriate range). If the contact pressure of the contact terminal falls below the appropriate range, shortage of the contact pressure hinders electrical continuity, and an adequate electric power supply to the heater becomes difficult. In contrast, if the contact pressure of the contact terminal 72 exceeds an appropriate range, excessive contact pressure causes the electrode or the contact terminal to be abraded, and power supply to the heater 22 cannot be performed well. The heater moves slightly because the heater expands and contracts in the longitudinal direction of the heater due to heat and vibrates when the fixing belt vibrates due to the speed fluctuation when the gear does not mesh properly with the pressure roller is out of place. In addition, the heater and the heater holder move slightly because sliding friction works the heater and the heater holder when the fixing belt slides on the heater and the heater holder.

A description is given of the detailed configuration of the heating device according to the present embodiment as follows. In the configuration according to the present embodiment, the following measures are taken to prevent above-described contact pressure defects (insufficient contact pressure or excessive contact pressure) of the contact terminals 72.

Figure 7:
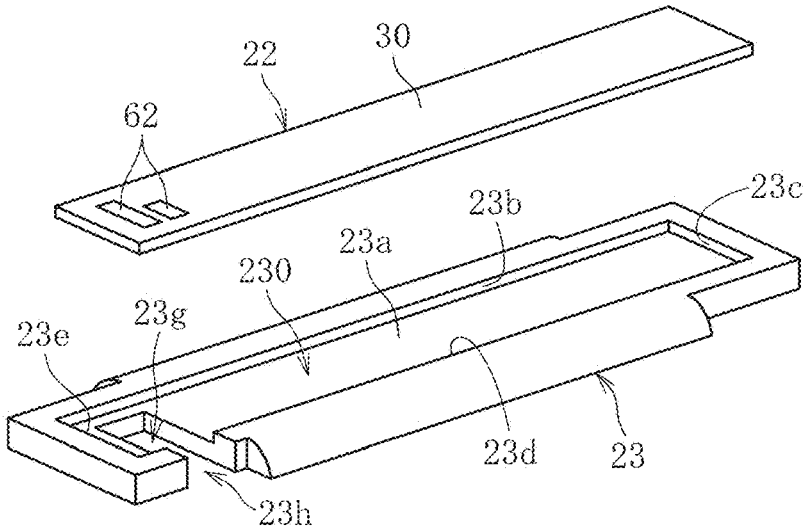
FIG. 7 is a perspective view illustrating the heater and a heater holder according to a first embodiment of the present disclosure.
Figure 8:
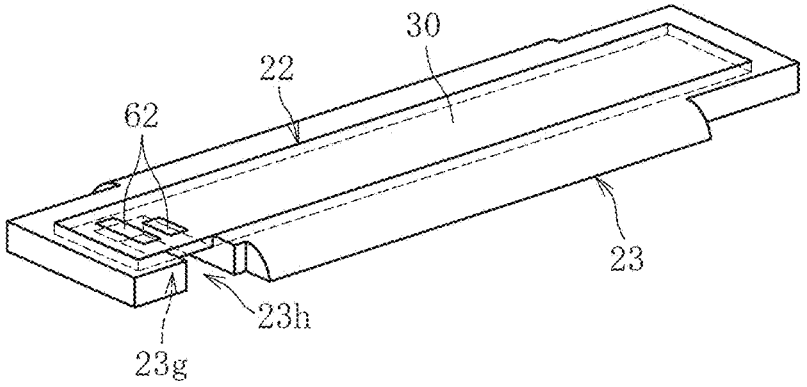
FIG. 8 is a perspective view illustrating the heater held by the heater holder.
Figure 9:
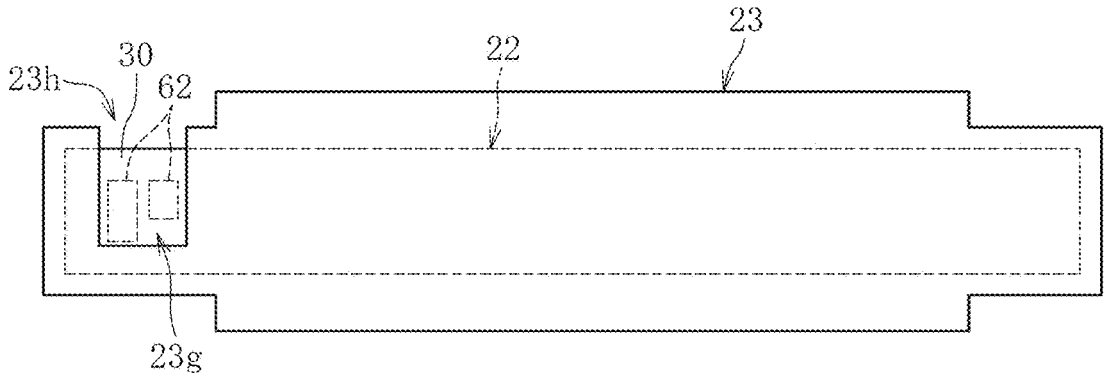
FIG. 9 is a bottom view illustrating the heater held by the heater holder.

FIG. 7 is a perspective view illustrating the heater 22 and the heater holder 23 according to the present embodiment. FIG. 8 is a perspective view illustrating the heater 22 held by the heater holder 23 according to the present embodiment. FIG. 9 is a bottom view illustrating the heater 22 and the heater holder 23 which are illustrated in FIG. 8, viewed from a back side of the heater holder 23, In FIGS. 7 to 9, only the base layer 30 and the electrodes 62 of the heater 22 are illustrated, and the other components are omitted.

As illustrated in FIGS. 7 to 9, the heater holder 23 according to the present embodiment includes a recessed portion 230 in which the heater 22 is accommodated. The recessed portion 230 has a bottom portion 23*a* formed in a rectangular shape substantially the same size as the heater 22, and four side surface portions 23*b*, 23*c*, 23*d*, and 23*e* provided on each side (four sides) of the bottom portion 23*a*. In particular, the bottom portion 23*a* in the recessed portion 230 functions as a contact portion that contacts the heater 22 in the thickness direction of the heater 22 in order to support the heater 22 against the pressure from the pressure roller 21. As illustrated in FIG. 9, the recessed portion 230 has a through-hole 23*g* penetrating form the front side of the heater holder to the back side of the heater holder at a position corresponding to the electrodes 62 of the heater 22, that is, the position that overlays the electrodes 62 when viewed from the side of the heater 22 held by the heater holder 23. As described above, in the present embodiment, since the heater holder 23 has the through-hole 23*g*, the heater holder 23 exists on the back side of the base layer 30 except for a portion corresponding to the electrodes 62. In other words, in the present embodiment, at least one part of the heater holder 23 is removed so as to expose the portion of the heater 22 corresponding to the electrode 62 on the back side of the heater 22 and opposite the electrode 62. This forms a plurality of portions in the heater holder 23 and a gap at a location corresponding to the electrode 62, existing between the plurality of portions. The term "portion of the heater 22 corresponding to the electrodes 62" means, in the thickness direction, a portion opposite a portion on which the electrodes 62 are disposed.

In addition, the heater holder 23 has a side opening 23*h* communicating with the through-hole 23*g* in a part of the outer wall extending in the longitudinal direction of the heater holder 23. The connector 70 is inserted from the side opening 23*h* into the through-hole 23*g* and attached to the heater 22 and the heater holder 23.

Figure 10:
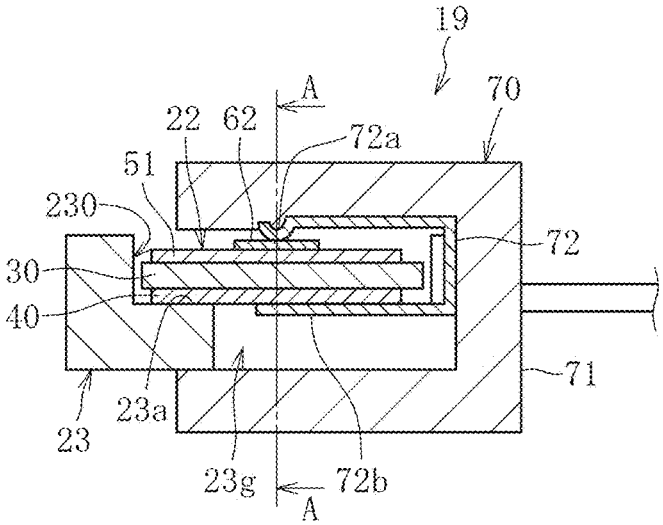
FIG. 10 is a cross-sectional view illustrating the connector connected to the heater.
Figure 11:
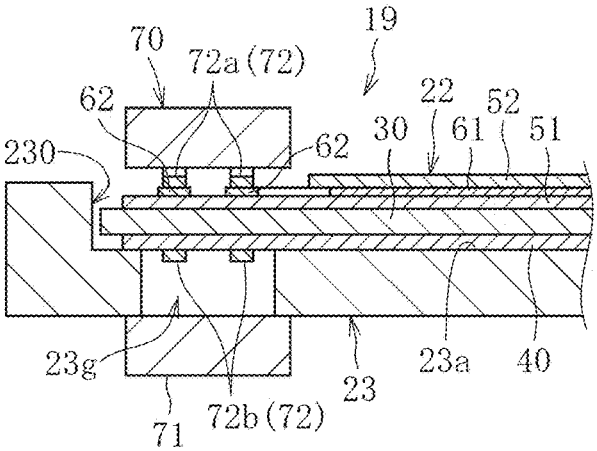
FIG. 11 is a cross-sectional view of the connector along a line A-A of FIG. 10.

FIG. 10 is a cross-sectional view illustrating the connector 70 attached to the heater 22 and the heater holder 23, and FIG. 11 is a cross-sectional view taken along the line A-A in FIG. 10.

As illustrated in FIGS. 10 and 11, when the connector 70 is attached, the pair of contact portions 72*a* of the contact terminal 72 contact the electrodes 62. Further, facing contact portions 72*b* of the contact terminal 72 that faces the contact portions 72*a* are inserted into the through-hole 23*g* of the heater holder 23 and contacts the back surface of the heater 22 which is the heat insulation layer 40. As described above, the contact portions 72*a* and the facing contact portion 72*b* of the contact terminal 72 sandwich the heater 22 from the front side and the back side of the heater 22 to hold the heater 22.

On the other hand, a portion of the housing 71 of the connector 70 disposed on the back side of the heater 22 is not inserted into the through-hole 23*g* of the heater holder 23 and contacts the back-side surface of the heater holder 23. As described above, when the housing 71 contacts the back surface of the heater holder 23, the housing 71 and the contact terminal 72 work together to sandwich the heater 22 and the heater holder 23 from the front side of the heater 22 and the back side of the heater holder 23. This prevents separation between the heater 22 and the heater holder 23.

Figure 12:
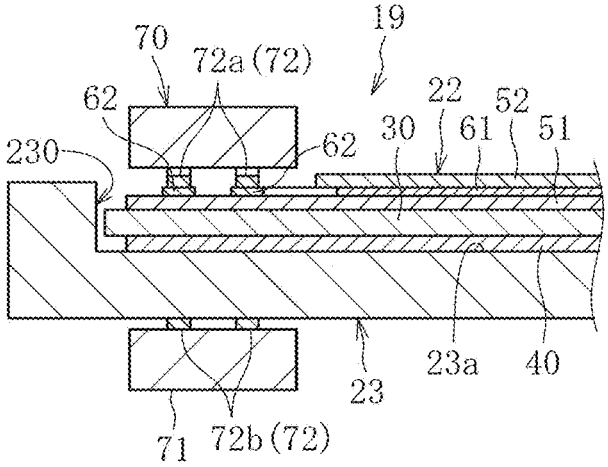
FIG. 12 is a cross-sectional view illustrating a comparative example in which the contact terminal sandwiches and holds the heater and the heater holder together.

As described above, in the present embodiment, the contact terminal 72 is attached so as to sandwich the heater 22 without sandwiching the heater holder 23. The number of parts sandwiched by the contact terminal 72 that is attached to sandwich only the heater 22 without sandwiching the heater holder 23 is smaller than the number of parts sandwiched by the contact terminal 72 as illustrated in FIG. 12 that sandwiches and holds the heater 22 and the heater holder 23 together by the heater holder 23 that is not sandwiched. Therefore, the variation in the contact pressure of the contact terminal 72 due to the combined tolerances in the thicknesses of parts is reduced. That is, in the present embodiment, since the contact pressure of the contact terminal 72 is not influenced by the variation in the thickness of the heater holder 23, it is possible to reduce the variation in the contact pressure. As a result, since the contact pressure can be easily managed and prevented from being insufficient or excessive, the contact pressure can be set to the appropriate value (that is, within the appropriate range). The through-hole 23*g* in the heater holder 23 of the present embodiment is disposed to prevent the contact pressure of the contact terminal 72 from being affected by the thickness of the heater holder 23, as described above, and is different from the hole provided to bring a temperature sensor (a temperature detection element) into contact with the heater 22 without the heater holder 23. That is, no temperature sensor is disposed in the through-hole 23*g* according to the present embodiment.

Figure 13:
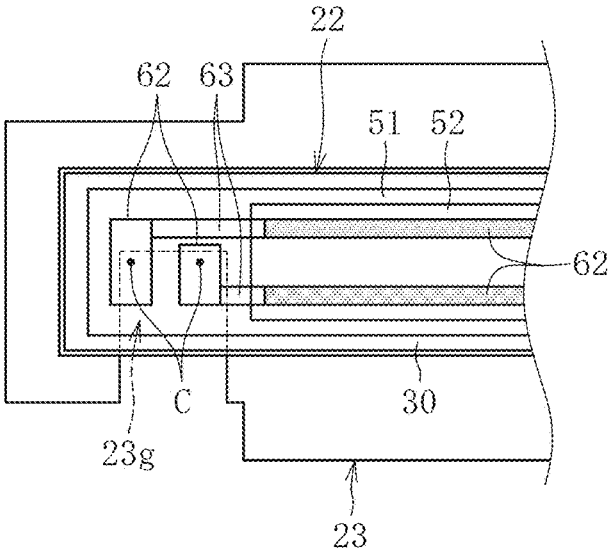
FIG. 13 is a plan view illustrating an arrangement of holes with respect to contact points between contact terminals and electrode portions.

In order to effectively reduce the variation in the contact pressure of the contact terminal 72, as illustrated in FIG. 13, it is desirable that the portion on which the heater holder 23 is not disposed, that is, the through-hole 23*g* includes at least a portion corresponding to a contact point C at which the contact terminal 72 contacts the electrodes 62 in a plan view that is, in FIG. 13. The portion on which the heater holder 23 is not disposed may not necessarily include the entire electrodes 62.

Preferably, the length in the penetration direction of the through-hole 23*g* is substantially the same in the entire circumference of the through-hole 23*g*.

Figure 14:
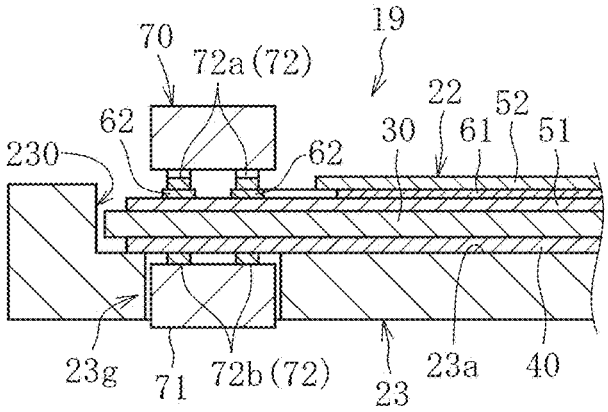
FIG. 14 is a cross-sectional view illustrating an example in which the connector holds the heater.
Figure 15:
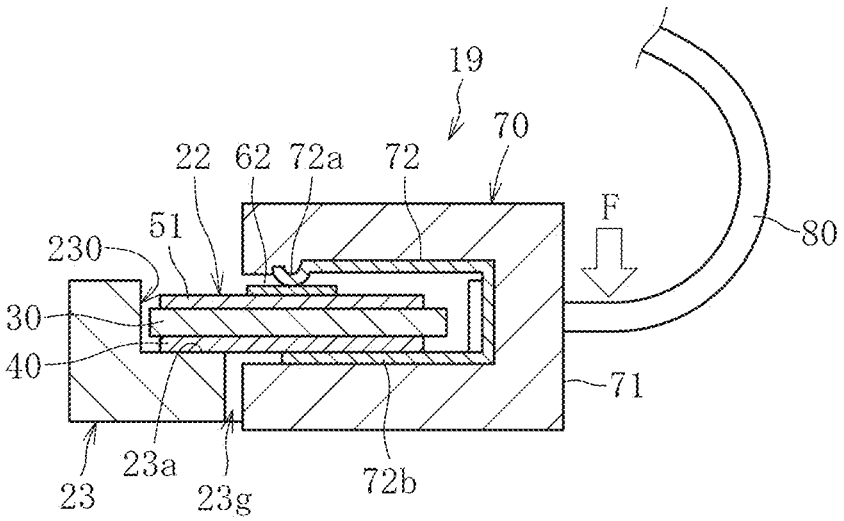
FIG. 15 is a cross-sectional view illustrating a configuration in which an elastic restoring force of a harness presses the heater against the heater holder.

Although the housing 71 of the connector 70 and the contact terminal 72 work together to hold the heater 22 and the heater holder 23 so that the heater 22 does not separate from the heater holder 23 in the example illustrated in FIGS. 10 and 11, if another method can prevent separation between the heater 22 and the heater holder 23, both the housing 71 of the connector 70 and the contact terminal 72 may sandwich and hold the heater 22 as in the example illustrated in FIG. 14. In this case, the method to restrict the separation between the heater 22 and the heater holder 23, for example, may use an elastic restoring force F that occurs when the bent harness 80 returns in a direction opposite the direction to which the harness 80 is bent as illustrated in FIG. 15. That is, since the elastic restoring force F of the harness 80 presses the heater 22 against the heater holder 23 (that is, the bottom portion 23*a* in the recessed portion 230) via the connector 70, the elastic restoring force F can prevent the separation between the heater 22 and the heater holder 23.

A second embodiment of the present disclosure is described below.

Figure 16:
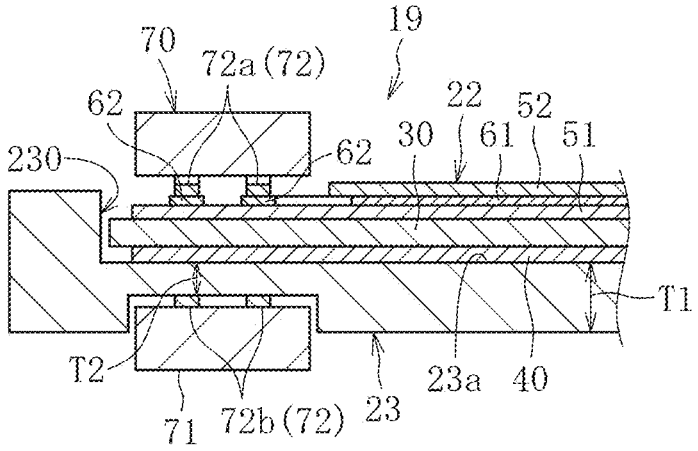
FIG. 16 is a cross-sectional view illustrating a heating device according to a second embodiment of the present disclosure.

In the first embodiment described above, the heater holder 23 is removed the portion corresponding to the electrodes 62, that is, the heater holder 23 is not provided in the portion corresponding to the electrode 62, but in a second embodiment of the present disclosure, as illustrated in FIG. 16, the back side of the heater holder 23 is partially recessed portioned to reduce the thickness of the heater holder 23 at the portion corresponding to the electrodes 62 (T1>T2). In other words, in the back side of the heater 22 and opposite the electrode 62, at least one part of the contact portion (that is, the bottom portion 23*a*) of the heater holder 23 facing the portion of the heater 22 corresponding to the electrode 62 is thinner than another part of the contact portion (that is, the bottom portion 23*a*). In this case, the heater holder 23 has a single portion, at least a part of the single portion corresponding to the electrode 62, being relatively thinner than a part of the single portion corresponding to the heat generator 61. That is, with reference to FIG. 16, a thickness T2 of the heater holder 23 corresponding to the electrode 62 is thinner than the thickness T1 of the heater holder 23 corresponding to the heat generator 61. When the thickness of the heater holder 23 corresponding to the heat generator 61 is partially different, the thickness T1 is the thickness of the thickest portion of the heater holder 23 corresponding to the heat generator 61.

As described above, the term "portion of the heater 22 corresponding to the electrodes 62" means, in the thickness direction, the portion opposite the portion on which the electrodes 62 are disposed. Reducing the thickness of the heater holder 23 in the portion corresponding to the electrode 62 can reduce variation in the thickness of the heater holder 23 at the portion. Since this reduces the combined tolerances in the thicknesses of portions (in this case, the heater 22 and the heater holder 23) sandwiched by the contact terminals 72, it is possible to reduce the variation in the contact pressure of the contact terminals 72 with the electrode 62. As a result, since the contact pressure can be easily managed and prevented from being insufficient or excessive, the contact pressure can be set to the appropriate value (that is, within the appropriate range).

As described above, in the fixing device according to the present disclosure, the portion of the heater holder corresponding to at least one part of the electrode (that is, the contact point C) is either removed entirely or made thinner. This can reduce the variation in thickness of a portion sandwiched by the contact terminal and prevent contact pressure failure of the connector with respect to the heater. Thereby, the conductivity of the connector with respect to the heater can be favorably secured, and the reliability is improved.

As the laminated heater used for a fixing device, etc., in addition to the laminated heater that includes the heat generator and the electrode on the front side of the base layer as in the above embodiment, there is the laminated heater that includes the heat generator and the electrode on both of the front side of the base layer and the back side of the base layer. In the present disclosure, another electrode is not disposed on the portion of the plate, the portion corresponding to the electrode, on the face opposite the face on which the electrode on the plate of the heater is disposed. The reason is as follows. The planar heater that includes the electrodes in the same portion on both the front side and the back side needs not providing the heater holder in the portion corresponding to the electrode on the back side to expose the electrode on the back side in addition to the electrode on the front side. However, the present disclosure is based on a totally different technical idea from that in which a part of the heater holder is necessarily removed in order to ensure the function of the electrode on the back side described above. That is, the present disclosure removes the portion of the heater holder, the portion corresponding to the electrode to reduce the variation in the contact pressure of the contact terminal with respect to the electrode in the configuration that does not need to remove a part of the heater holder to ensure the function of the electrode on the back side.

In the above embodiment, although the surface on which the electrode is provided is the front side of the plate, the surface on which the electrode is provided may be the surface on the back side opposite the surface on the front side in the above embodiment. The surface on which the electrode is provided is appropriately designed. The number of electrodes and positions of electrodes are not limited to that described above. For example, one electrode may be provided on one end side of the plate in the longitudinal direction, and the other electrode may be provided on the other end side of the plate in the longitudinal direction. The electrode may be provided on the same surface of the plate, but alternatively one electrode may be provided on the front side and on one end side of the plate in the longitudinal direction, and the other electrode may be provided on the back side and on the other end side of the plate in the longitudinal direction. That is, it is sufficient that the other electrode is not provided in the portion of the plate corresponding to the electrode on the surface opposite the surface on which the electrode is provided, and the electrode may not be provided only on the same side of the plate. The configuration in which the electrodes are provided on one end side of the plate in the longitudinal direction has an advantage that a number of connectors connected to the electrodes becomes smaller than the configuration in which the electrodes are provided on both end sides of the plate in the longitudinal direction.

The present disclosure is not limited to the details of the embodiments described above and various modifications and improvements are possible.

Figure 17:
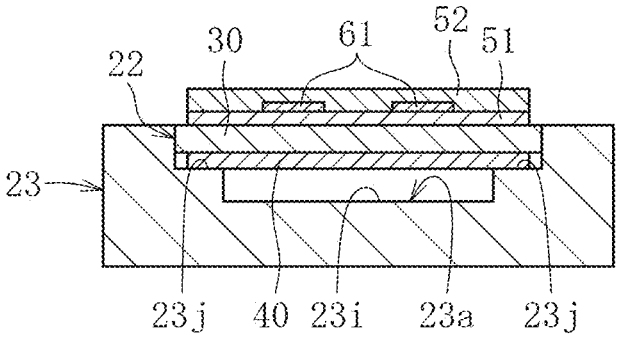
FIG. 17 is a cross-sectional view illustrating a variation of the heater holder.

In the above embodiment, the heater holder 23 has the flat bottom portion 23*a* (contact portion) that contacts the heater 22 over the entire area including both end sides and the center portion in the short side direction (See FIG. 7). However, as in the example illustrated in FIG. 17, the bottom portion 23*a* may have a recessed portion 23*i* to be step-like. In this case, a step portion 23*j* of the heater holder 23 is the contact portion that contacts the heater 22 in the thickness direction of the heater 22 at both ends in the short side direction. The above-described configuration in which the bottom portion 23*a* of the heater holder 23 has the recessed portion 23*i* so that the heater holder 23 does not contact the center portion of the heater 22 in the short side direction can reduce heat transfer from the heater 22 to the heater holder 23 and improve the energy saving effect.

Moreover, in the above-described embodiment, although the electrode 62 of the heater 22 is connected to the heat generator 61, the present disclosure is not limited to this. For example, the present disclosure is also applicable to a configuration in which the electrode is connected to a temperature sensor such as a thermistor.

Figure 18:
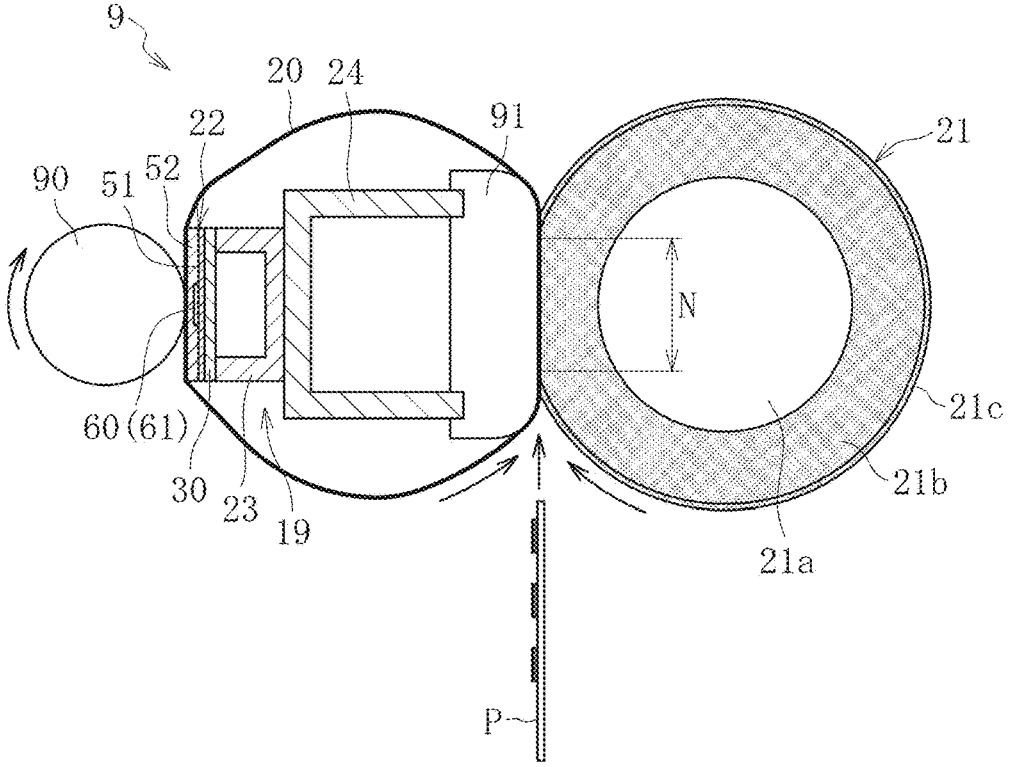
FIG. 18 is a schematic diagram illustrating a configuration of another fixing device.
Figure 19:
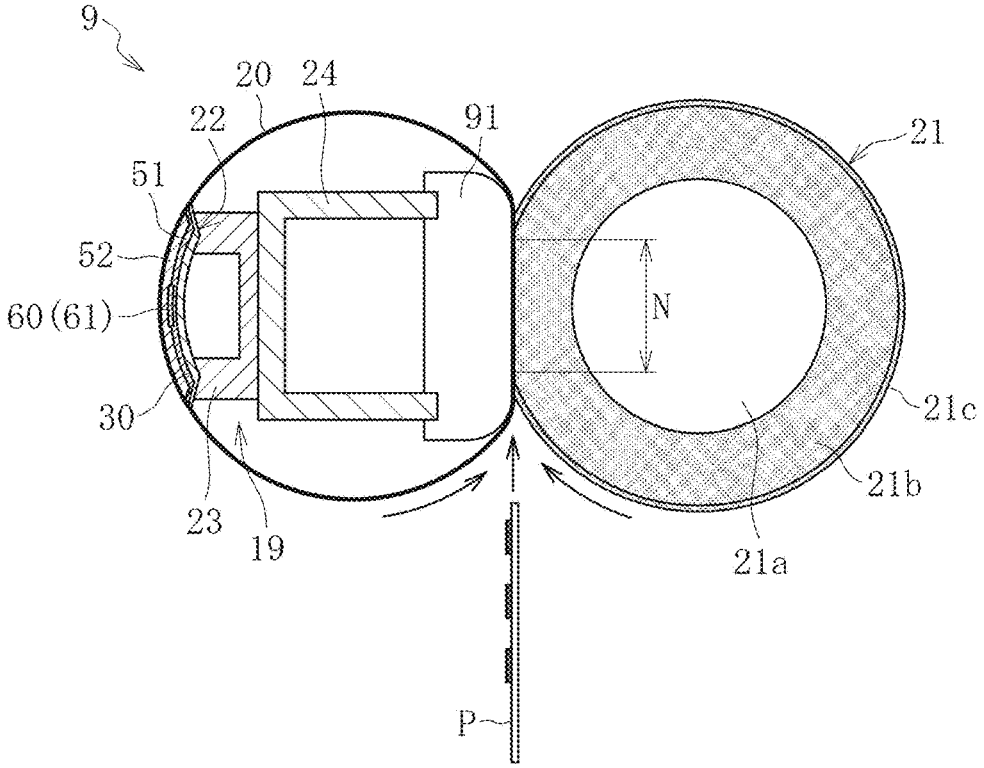
FIG. 19 is a schematic diagram illustrating a configuration of still another fixing device.
Figure 20:
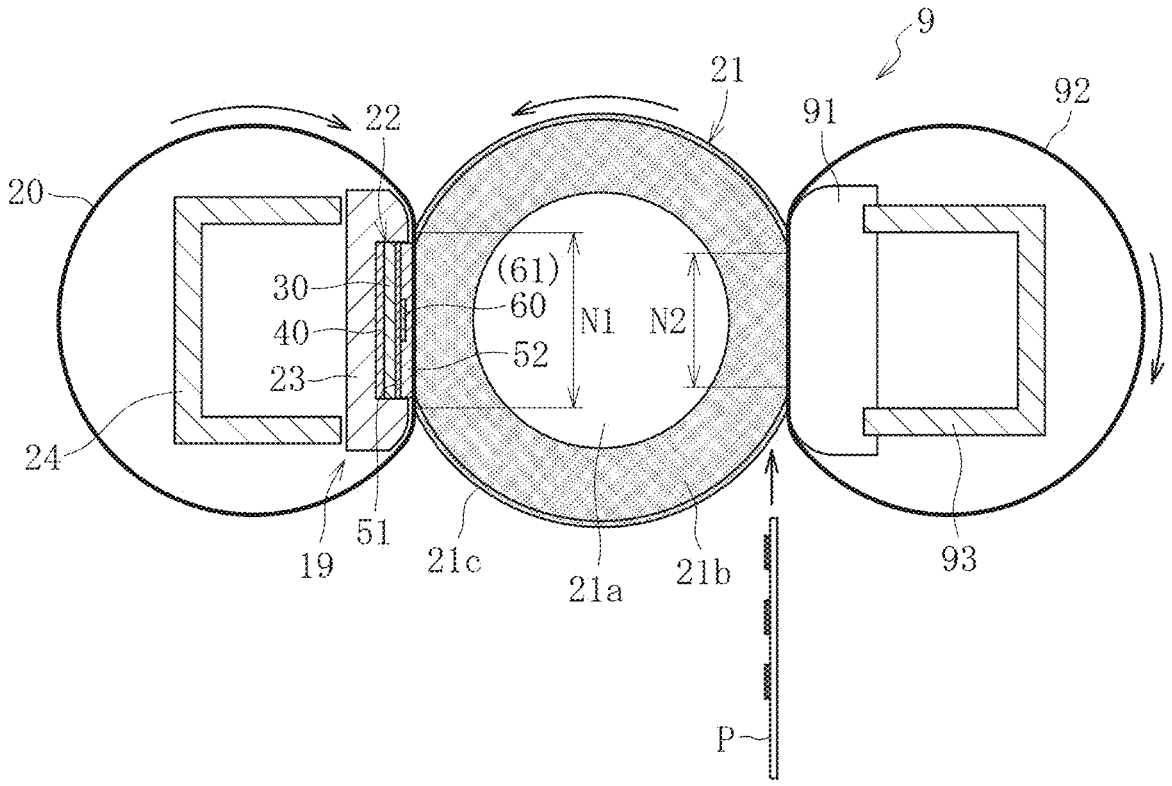
FIG. 20 is a schematic diagram illustrating a configuration of a further different fixing device.

The present disclosure is also applicable to fixing devices as illustrated in FIGS. 18 to 20, in addition to the fixing device illustrated in FIG. 2. The configurations of fixing devices illustrated in FIGS. 18 to 20 are briefly described below.

First, the fixing device 9 illustrated in FIG. 18 includes a pressurization roller 90 opposite the pressure roller 21 with respect to the fixing belt 20 and heats the fixing belt 20 sandwiched by the pressurization roller 90 and the heater 22. On the other hand, in the side of the pressure roller 21, a nip formation pad 91 is disposed inside the inner circumferential surface of the fixing belt 20. The stay 24 supports the nip formation pad 91, and the nip formation pad 91 and the pressure roller 21 sandwiches the fixing belt 20 to form the nip N.

Next, the fixing device 9 illustrated in FIG. 19 is omitted the above described pressurization roller 90 and includes the heater 22 configured by an arc-shaped plate having a curvature of the fixing belt 20 to keep a circumferential contact length between the fixing belt 20 and the heater 22. The fixing device 9 illustrated in FIG. 19 is identical to the fixing device 9 illustrated in FIG. 18 in terms of the others.

Lastly, the fixing device 9 illustrated in FIG. 20 includes a pressing belt 92 in addition to the fixing belt 20 and has a heating nip (a first nip) N1 and the fixing nip (a second nip) N2 separately. That is, the nip formation pad 91 and the stay 93 are disposed opposite the fixing belt 20 with respect to the pressure roller 21 and the pressing belt 92 is rotatably arranged to wrap around the nip formation pad 91 and the stay 93. The sheet P passes through the fixing nip N2 between the pressing belt 92 and the pressure roller 21 and is applied to heat and pressure, and the image is fixed on the sheet P. The fixing device 9 illustrated in FIG. 20 is identical to the fixing device 9 illustrated in FIG. 2 in terms of the others.

In addition to the above-described fixing device, the present disclosure is also applicable to a dryer to dry ink applied to the sheet and a heating device used in a coating device (a laminator) that heats, under pressure, a film as a covering member onto the surface of the sheet such as paper.

The image forming apparatus 100 according to the embodiments of the present disclosure may be a copier, a facsimile machine, a multifunction peripheral (MFP) having at least two of copying, printing, scanning, facsimile, and plotter functions in addition to the printer. Embodiments of the present disclosure may be applied to an ink jet type image forming apparatus in addition to the electrophotographic type image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating device comprising:

a heater including:

a plate;

an electrode disposed on one surface of the plate; and a heat generator, the heater not including another electrode on the other surface of the plate opposite the one surface on which the electrode is disposed, and in a portion on the plate corresponding to the electrode; and a holder including:

a contact portion to contact the plate in a thickness direction of the plate; and at least one of a plurality of portions, a gap at a location corresponding to the electrode, existing between the plurality of portions and a single portion, at least a part of the single portion corresponding to the electrode, being relatively thinner than a part of the single portion corresponding to the heat generator.

2. The heating device according to claim 1, wherein the holder has a through-hole at the location corresponding to the electrode.

3. The heating device according to claim 1, further comprising a contact terminal to contact the electrode to supply power to the heat generator, wherein the contact terminal sandwiches and holds the heater at a position corresponding to the electrode.

4. The heating device according to claim 3, further comprising a power supply harness coupled to the contact terminal, wherein the power supply harness is bent and presses the heater against the holder.

5. The heating device according to claim 1, further comprising a contact terminal to contact the electrode to supply power to the heat generator, wherein the contact terminal sandwiches and holds the heater and the holder together at a position corresponding to the electrode.

6. The heating device according to claim 1, wherein the contact portion of the holder contacts both ends of the plate in a short side direction of the plate, the ends being at an end of the plate in the thickness direction.

7. The heating device according to claim 1, wherein the contact portion of the holder contacts the plate at a center portion of the plate in a short side direction of the plate, the center portion being at an end of the plate in the thickness direction.

8. A fixing device comprising:

the heating device according to claim 1;

a fixing rotator heated by the heating device; and an opposed rotator that contacts the fixing rotator to form a nip.

9. An image forming apparatus comprising the heating device according to claim 1.

10. The image forming apparatus according to claim 9, wherein the holder has a through-hole at the location corresponding to the electrode.

11. The image forming apparatus according to claim 9, further comprising:

a contact terminal to contact the electrode to supply power to the heat generator, wherein the contact terminal sandwiches and holds the heater at a position corresponding to the electrode.

12. The image forming apparatus according to claim 11, further comprising:

a power supply harness coupled to the contact terminal, wherein the power supply harness is bent and presses the heater against the holder.

13. The image forming apparatus according to claim 9, further comprising:

a contact terminal to contact the electrode to supply power to the heat generator, wherein the contact terminal sandwiches and holds the heater and the holder together at a position corresponding to the electrode.

14. The image forming apparatus according to claim 9, wherein the contact portion of the holder contacts both ends of the plate in a short side direction of the plate, the ends being at an end of the plate in a thickness direction of the plate.

15. The image forming apparatus according to claim 9, wherein the contact portion of the holder contacts the plate at a center portion of the plate in a short side direction of the plate, the center portion being at an end of the plate in a thickness direction of the plate.

16. The heating device according to claim 1, wherein the contact portion contacts the plate in a thickness direction of the plate.

17. A heating device comprising:

a heater including:

a plate;

an electrode disposed on one surface of the plate, the heater not including another electrode on the other surface of the plate opposite the one surface on which the electrode is disposed, and in a portion on the plate corresponding to the electrode; and a heat generator; and a holder including a contact portion to contact the plate, wherein at least a part of the electrode does not face the holder.

18. The heating device according to claim 17, wherein the contact portion contacts the plate in a thickness direction of the plate, and the heating device further comprises:

a contact terminal to contact the electrode to supply power to the heat generator, wherein the contact terminal sandwiches and holds the heater at a position corresponding to the electrode.

19. The heating device according to claim 18, further comprising:

a power supply harness coupled to the contact terminal, wherein the power supply harness is bent and presses the heater against the holder.

20. The heating device according to claim 17, wherein a portion corresponding to the electrode on the other surface of the plate does not face the holder.

21. The heating device according to claim 17, further comprising:

a contact terminal configured to contact the electrode to supply power to the heat generator, wherein a portion on the plate corresponding to a contact point at which the contact terminal contacts the electrode does not face the holder.

22. The heating device according to claim 17, further comprising:

a plurality of electrodes including the electrode, where the plurality of electrodes are disposed at the same side in a longitudinal direction of the plate.

23. The heating device according to claim 17, wherein the plate includes a base layer made of metal.

24. The heating device according to claim 23, wherein the plate includes the base layer made of stainless steel.

25. A fixing device comprising:

the heating device according to claim 17;

a fixing rotator heated by the heating device; and an opposed rotator that contacts the fixing rotator to form a nip.

26. An image forming apparatus comprising:

the heating the fixing device according to claim 25.

27. The fixing device according to claim 25, wherein the electrode is on a nip side of the plate.

* * * * *